US007071767B2

(12) United States Patent
Ou-yang et al.

(10) Patent No.: US 7,071,767 B2
(45) Date of Patent: Jul. 4, 2006

(54) PRECISE VOLTAGE/CURRENT REFERENCE CIRCUIT USING CURRENT-MODE TECHNIQUE IN CMOS TECHNOLOGY

(75) Inventors: Qing Ou-yang, Shanghai (CN); Howard Yang, Shanghai (CN); YuFei Gu, Shanghai (CN)

(73) Assignee: Integrated Device Technology, Inc., San Jose, CA (US)

( * ) Notice: Subject to any disclaimer, the term of this patent is extended or adjusted under 35 U.S.C. 154(b) by 0 days.

(21) Appl. No.: 10/832,986

(22) Filed: Apr. 26, 2004

(65) Prior Publication Data

US 2005/0035814 A1 Feb. 17, 2005

(30) Foreign Application Priority Data

Aug. 15, 2003 (CN) ..... 03 1 54092

(51) Int. Cl.
*G05F 1/10* (2006.01)

(52) U.S. Cl. ..... 327/539

(58) Field of Classification Search ..... 323/313; 327/539

See application file for complete search history.

(56) References Cited

U.S. PATENT DOCUMENTS

| | | | | |
|---|---|---|---|---|
| 6,452,437 | B1 * | 9/2002 | Takeuchi et al. | 327/513 |
| 6,489,835 | B1 * | 12/2002 | Yu et al. | 327/539 |
| 6,690,228 | B1 * | 2/2004 | Chen et al. | 327/538 |
| 6,724,176 | B1 * | 4/2004 | Wong et al. | 323/316 |
| 6,885,178 | B1 * | 4/2005 | Marinca | 323/316 |

* cited by examiner

*Primary Examiner*—Jeffrey Zweizig
(74) *Attorney, Agent, or Firm*—Bever, Hoffman & Harms

(57) ABSTRACT

A voltage/current reference circuit includes a first bipolar transistor and a second bipolar transistor that exhibit a first voltage drop $V_{BE1}$ and a second voltage drop $V_{BE2}$, respectively. A first resistor, having a resistance R1, is configured to draw a first current equal to $(V_{BE1}-V_{BE2})/R1$. A second resistor, having a resistance R2, is configured to draw a second current equal to $V_{BE1}/R2$. A first transistor supplies the first and second currents to the first and second resistors. A second transistor, having a current mirror configuration with respect to the first transistor, directly provides a reference current equal to $(V_{BE1}-V_{BE2})/R1+V_{BE1}/R2$. A third transistor, having a current mirror configuration with respect to the first transistor, provides a current equal to the reference current to a third resistor having a resistance R3 and a third bipolar transistor that exhibits a third voltage drop $V_{BE3}$, thereby generating a reference voltage.

18 Claims, 6 Drawing Sheets

PRECISE VOLTAGE/CURRENT REFERENCE CIRCUIT USING CURRENT-MODE TECHNIQUE IN CMOS TECHNOLOGY

FIELD OF THE INVENTION

The present invention relates to a precise voltage/current reference circuit that is insensitive to variations in temperature and power supply voltage. More specifically, the present invention relates to a voltage/current reference circuit using a current-mode technique in CMOS technology.

RELATED ART

FIG. 1 is a circuit diagram of a conventional on-chip bandgap voltage reference circuit 100 used in CMOS analog/mixed signal chips. Voltage reference circuit 100 includes PMOS transistors 101–102, operational amplifier 105, resistors 111–113 and PNP bipolar transistors 121–122, which are connected as illustrated. Resistors 111, 112 and 113 have resistances of R1, R2 and R3, respectively. The input voltages to the "+" and "−" input terminals of operational amplifier 105 are labeled as input voltages V+ and V−, respectively. The base-to-emitter voltage of bipolar transistor 121 is designated $V_{BE1}$, and the base-to-emitter voltage of bipolar transistor 122 is designated $V_{BE2}$. The input voltage V− is therefore equal to $V_{BE1}$. The input voltages V+ and V− are forced to be equal, such that the input voltage V+ is also equal to $V_{BE1}$.

The voltage across resistor 113, designated as $\Delta V_{BE}$, can therefore be defined as follows.

$$\Delta V_{BE}=V_{BE1}-V_{BE2} \tag{1}$$

The current $I_{113}$ through resistor 113 can then be defined as follows.

$$I_{113}=\Delta V_{BE}/R3 \tag{2}$$

The voltage drop across resistor 112, (i.e., $V_{112}$), can therefore be defined as follows.

$$V_{112}=I_{113}\times R2=\Delta V_{BE}\times R2/R3 \tag{3}$$

Thus, the reference voltage $V_{REF1}$ can be defined as follows.

$$V_{REF1}=V_{BE1}+\Delta V_{BE}\times R2/R3 \tag{4}$$

The voltage $\Delta V_{BE}$ is proportional to the threshold voltage $V_T$. The voltage $V_{BE1}$ has a negative temperature coefficient of about −2 mV/° C., whereas $V_T$ has a positive temperature coefficient of 0.086 mV/° C. As a result, the temperature variation of $V_{REF1}$ can be compensated by the ratio of R2/R3.

FIG. 2 is a circuit diagram of another conventional on-chip bandgap voltage reference circuit 200 used in CMOS analog/mixed signal chips. Voltage reference circuit 200 includes PMOS transistors 201–203, operational amplifier 205, resistors 211–214 and PNP bipolar transistors 221–222, which are connected as illustrated. PMOS transistors 201–203 are all the same size. The currents through PMOS transistors 201, 202 and 203 are designated as $I_1$, $I_2$ and $I_3$, respectively. Resistors 211, 212, 213 and 214 have resistances of R1, R2, R3 and R4, respectively. Resistance R1 is equal to resistance R2. The input voltages to the "+" and "−" input terminals of operational amplifier 205 are labeled as input voltages V+ and V−, respectively. The base-to-emitter voltage of bipolar transistor 221 is designated $V_{BE1}$, and the base-to-emitter voltage of bipolar transistor 222 is designated $V_{BE2}$. The input voltage V− is therefore equal to $V_{BE1}$. Operational amplifier 205 forces the input voltages V+ and V− to be equal, such that the input voltage V+ is also equal to $V_{BE1}$.

Because PMOS transistors 201–203 are identical, and R1 is equal to R2, the currents $I_1$, $I_2$ and $I_3$ are equal to one another.

$$I_1=I_2=I_3 \tag{5}$$

Because the voltage V+ is equal to the voltage V−, the current through resistor 211 (i.e., $I_{1B}$) is equal to the current through resistor 212 (i.e., $I_{2B}$).

$$I_{1B}=I_{2B} \tag{6}$$

As a result, the current through bipolar transistor 221 (i.e., $I_{1A}$) is equal to the current through resistor 213 and bipolar transistor 222 (i.e., $I_{2A}$)

$$I_{1A}=I_{2A} \tag{7}$$

The current $I_{2A}$ through resistor 213 can be defined as follows. This current $I_{2A}$ is proportional to the threshold voltage $V_T$.

$$I_{2A}=\Delta V_{BE}/R3 \tag{8}$$

The current $I_{2B}$ through resistor 212 can be defined as follows. This current $I_{2B}$ is proportional to $V_{BE1}$.

$$I_{2B}=V_{BE1}/R2 \tag{9}$$

Current $I_3$ can therefore be defined as follows.

$$I_3=I_2=I_{2A}+I_{2B} \tag{10}$$

As a result, the output reference voltage $V_{REF2}$, which is equal to the current $I_3\times$R4, can be defined as follows.

$$V_{REF2}=R4\times(\Delta V_{BE}/R3+V_{BE1}/R2) \tag{11}$$

As described above, the voltage $\Delta V_{BE}$ is proportional to the threshold voltage $V_T$, which has a positive temperature coefficient of 0.086 mV/° C., and the voltage $V_{BE1}$ has a negative temperature coefficient of about −2 mV/° C. Thus, the temperature variation of $V_{REF2}$ can be compensated by the resistance ratio R2, R3 and R4.

FIG. 3 is a graph 300 that illustrates a simulated DC voltage sweep from 0 Volts to 3 Volts on the gates of transistors 201–203 (line 301), and the resultant output voltage of operational amplifier 205 (line 302). In this simulation, the output terminal of operational amplifier 205 is disconnected from the gates of PMOS transistors 201–203. Graph 300 illustrates that there are three cross-points, A, B and C, where the output of operational amplifier 205 is equal to the voltage applied to the gates of transistors 201–203. Thus, there are three possible steady state operating conditions for reference circuit 200. However, only one of these operating conditions (cross-point A) represents the desired operating conditions of the reference circuit 200. Reference circuit 200 may or may not end up in the desired operating state, depending upon the mismatch between the currents $I_1$, and $I_2$ or the resistances R1 and R2.

Moreover, as described above, reference circuits 100 and 200 are both voltage references. If a current reference is needed, a voltage-to-current conversion circuit is typically used, wherein the reference voltage is applied to a resistor, thereby creating an associated reference current $I_{REF}$. However, such a resistor has a positive temperature coefficient. Thus, while the reference voltage may be temperature insensitive, the reference current will vary with variations in temperature, due to the temperature dependence of the resistor. The process variation of the resistor is a major factor that degrades the precision of the current reference.

It would therefore be desirable to have a reference circuit capable of generating both a reference voltage and a reference current that are insensitive to variations in both temperature and power supply voltage. It would further be desirable for this reference circuit to have a single steady-state operating point.

SUMMARY

Accordingly, the present invention provides a reference circuit that includes a first bipolar transistor that exhibits a first base-to-emitter voltage $V_{BE1}$, and a second bipolar transistor that exhibits a second base-to-emitter voltage $V_{BE1}$, wherein $V_{BE1}$ is greater than $V_{BE2}$. The voltage $V_{BE1}$ is applied a one terminal of a first resistor, and the voltage $V_{BE2}$ is applied to the other terminal of the first resistor, such that a voltage of $V_{BE1}-V_{BE2}$ is applied across the first resistor. The first resistor has a resistance R1, such that a first current equal to $(V_{BE1}-V_{BE2})/R1$ flows through this first resistor.

A first MOS transistor is configured to supply the first and second currents to the first and second resistors. As a result, the first MOS transistor carries a current equal to the sum of the first and second currents, or $(V_{BE1}-V_{BE2})/R1+V_{BE1}/R2$. A second MOS transistor, having a current mirror configuration with respect to the first transistor, directly provides a reference current equal to $(V_{BE1}-V_{BE2})/R1+V_{BE1}/R2$. By properly selecting the ratio of resistances R1 and R2, the reference current can be made insensitive to variations in temperature and power supply voltage.

A third transistor, having a current mirror configuration with respect to the first transistor, provides a current equal to the reference current (i.e., $(V_{BE1}-V_{BE2})/R1+V_{BE1}/R2$) to a third resistor having a resistance R3. This third resistor is connected in series with a third bipolar transistor that exhibits a third base-to-emitter voltage $V_{BE3}$. As a result, the voltage drop across the third resistor and the third bipolar transistor is equal to $V_{BE3}+(R3\times(V_{BE1}-V_{BE2})/R1+R3\times V_{BE1}/R2)$. This voltage drop is used as a reference voltage. By properly selecting the ratio of the resistances R1, R2 and R3, the reference voltage can be made insensitive to variations in temperature and power supply voltage. Moreover, by properly selecting the ratio of the resistances R1, R2 and R3, the voltage and current reference circuit can be controlled to have a single steady-state operating point.

The present invention will be more fully understood in view of the following description and drawings.

DETAILED DESCRIPTION

Figure 4:
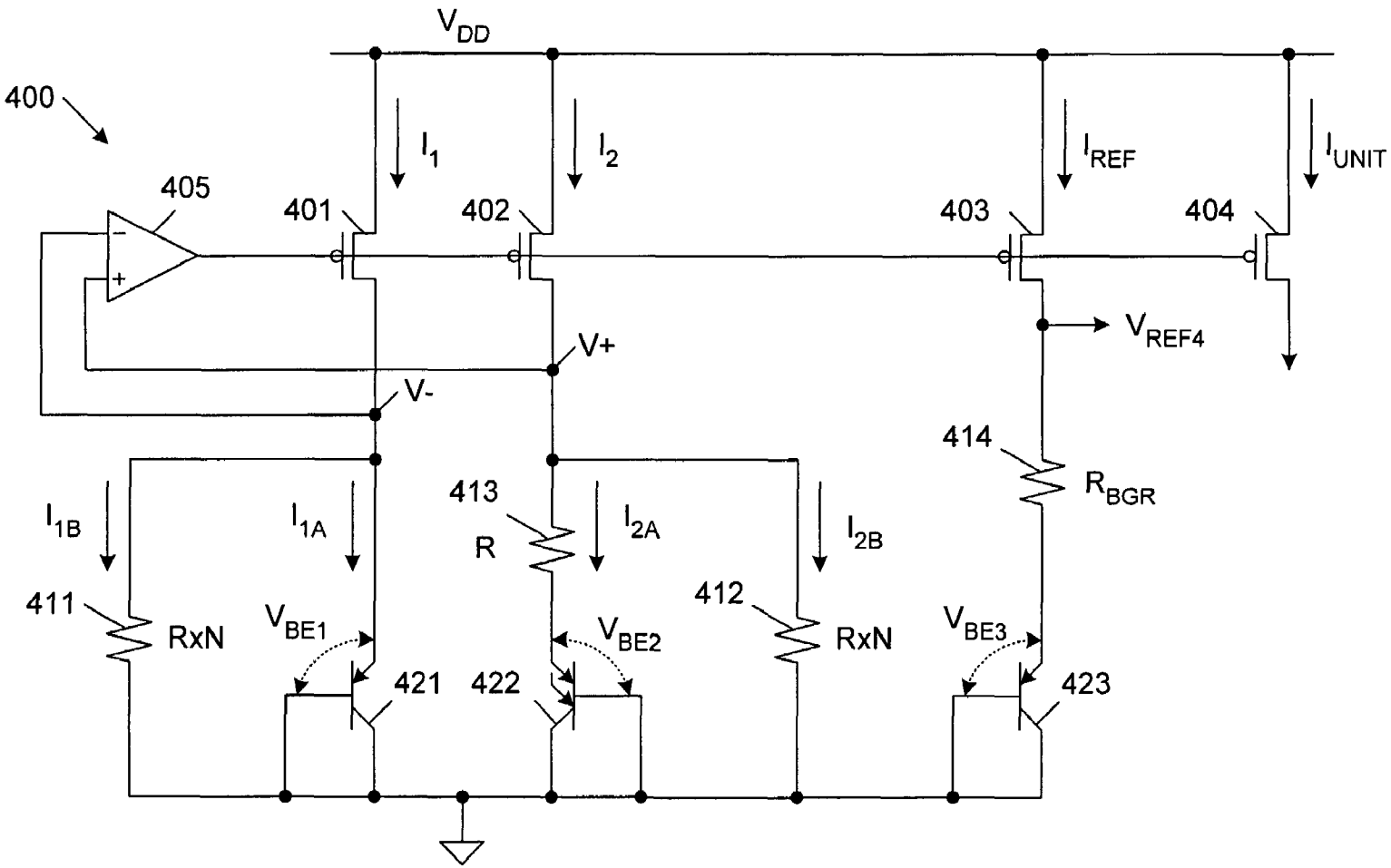
FIG. 4 is a circuit diagram of an on-chip bandgap voltage and current reference circuit in accordance with one embodiment of the present invention.

FIG. 4 is a circuit diagram of an on-chip bandgap voltage and current reference circuit 400 in accordance with one embodiment of the present invention. Voltage/current reference circuit 400 can be used, for example, in CMOS analog/mixed signal chips.

Voltage reference circuit 400 includes PMOS transistors 401–404, operational amplifier 405, resistors 411–414 and PNP bipolar transistors 421–423. The dimensions of PMOS transistors 401–404 are the same. The sources of PMOS transistors 401–404 are coupled to the $V_{DD}$ voltage supply terminal. The drains of PMOS transistors 401 and 402 are coupled to the "−" and "+" input terminals of operational amplifier 405. The input voltages to the "−" and "+" input terminals of operational amplifier 405 are labeled as input voltages V− and V+, respectively. The output terminal of operational amplifier 405 is coupled to the gates of PMOS transistors 401–404. The currents through PMOS transistors 401, 402, 403 and 404 are designated as $I_1$, $I_2$, $I_{REF}$, and $I_{UNIT}$, respectively. These currents are all equal to one another.

$$I_1=I_2=I_{REF}=I_{UNIT} \tag{12}$$

Resistor 411 and PNP bipolar transistor 421 are coupled in parallel between the drain of PMOS transistor 401 and the $V_{SS}$ (ground) voltage supply terminal. The base of PNP bipolar transistor 421 is also coupled to the $V_{SS}$ voltage supply terminal. The base-to-emitter voltage of bipolar transistor 421 is designated as voltage $V_{BE1}$. The input voltage V− is therefore equal to $V_{BE1}$. Operational amplifier 405 forces the input voltages V− and V+ to be equal, such that the input voltage V+ on the drain of PMOS transistor 402 is also equal to $V_{BE1}$. The currents through PNP bipolar transistor 421 and resistor 411 are designated as current $I_{1A}$ and current $I_{1B}$, respectively. Note that currents $I_1$, $I_{1A}$ and $I_{1B}$ exhibit the following relationship.

$$I_1=I_{1A}+I_{1B} \tag{13}$$

Resistor 412 and the series combination of resistor 413 and PNP bipolar transistor 422 are coupled in parallel between the drain of PMOS transistor 402 and the $V_{SS}$ voltage supply terminal. The base of PNP bipolar transistor 422 is also coupled to the $V_{SS}$ voltage supply terminal. The base-to-emitter voltage of bipolar transistor 422 is designated as voltage $V_{BE2}$. The current through resistor 413 and PNP bipolar transistor 422 is designated as current $I_{2A}$. The current through resistor 412 is designated as current $I_{2B}$. Note that currents $I_2$, $I_{2A}$ and $I_{2B}$ exhibit the following relationship.

$$I_2=I_{2A}+I_{2B} \tag{14}$$

Resistor 413 has a resistance of R, and resistors 411 and 412 each have a resistance of (R×N), where N is an integer.

Resistor 414 and PNP bipolar transistor 423 are coupled in series between the drain of PMOS transistor 403 and the $V_{SS}$ voltage supply terminal. The base of PNP bipolar transistor 423 is also coupled to the $V_{SS}$ voltage supply terminal. The base-to-emitter voltage of bipolar transistor 423 is designated as voltage $V_{BE3}$. Resistor 414 is a bandgap reference resistor that has a resistance designated $R_{BGR}$ and configured to provide the reference voltage $V_{REF4}$. The drain of PMOS transistor 403 is connected to resistor 414.

Reference circuit 400 operates as follows. As described above, operational amplifier 405 forces the voltages V+ and V− to be the same (i.e., $V_{BE1}$). The current $I_{1B}$ through resistor 411 and the current $I_{2B}$ through resistor 412 can therefore be defined as follows.

$$I_{1B}=I_{2B}=V_{BE1}/(R\times N) \quad (15)$$

Combining Equations (12), (13), (14) and (15) provides the following current relationship.

$$I_{1A}=I_{2A} \quad (16)$$

The voltage across resistor 413, designated as $\Delta V_{BE}$, can be defined as follows.

$$\Delta V_{BE}=V+-V_{BE2}=V_{BE1}-V_{BE2} \quad (17)$$

The current $I_{2A}$ through resistor 413 can therefore be defined as follows.

$$I_{2A}=\Delta V_{BE}/R \quad (18)$$

From Equations (14), (15) and (18), the current $I_2$ can be defined as follows.

$$I_2=\Delta V_{BE}/R+V_{BE1}/(R\times N) \quad (19)$$

The term $\Delta V_{BE}$ has a positive temperature coefficient, the term $V_{BE1}$ has a negative temperature coefficient and the resistance R has a positive temperature coefficient. As a result, the temperature variation of current $I_2$ can be compensated by the resistor ratio N. The current $I_2$ is mirrored to PMOS transistor 404 as the reference current $I_{UNIT}$. Thus, PMOS transistor 404 directly provides the desired reference current $I_{UNIT}$, which is insensitive to variations in temperature. Note that the resistor ratio N is selected to compensate the temperature variation of the current, not the voltage. As a result, the current reference $I_{UNIT}$ can be generated directly.

Circuit 400 also enables a reference voltage $V_{REF4}$ to be generated. The reference voltage $V_{REF4}$ can be defined as follows.

$$V_{REF4}=V_{BE3}+I_{REF}\times R_{BGR} \quad (20)$$

Because the current $I_{REF}$ is equal to the current $I_2$, equation (20) can be rewritten as follows.

$$V_{REF4} = V_{BE3} + [\Delta V_{BE} / R + V_{BE1} / (R\times N)] \times R_{BGR} \quad (21)$$

$$V_{REF4} = V_{BE3} + R_{BGR} \times \Delta V_{BE} / R + R_{BGR} \times V_{BE1} / (R\times N) \quad (22)$$

Because $\Delta V_{BE}$ has a negative temperature coefficient and $R_{BGR}$ has a positive temperature coefficient, the reference voltage $V_{REF4}$ can be independent of temperature when the resistor ratio N is properly selected. Moreover, the reference voltage $V_{REF4}$ is determined by the resistance ratio $R_{GBR}$/R, which is not significantly influenced by the absolute value of the resistances. In the foregoing manner, PNP bipolar transistor 423 and bandgap reference resistor 414 enable the generation of a voltage reference $V_{REF4}$ that is insensitive to temperature variation.

Figure 5:
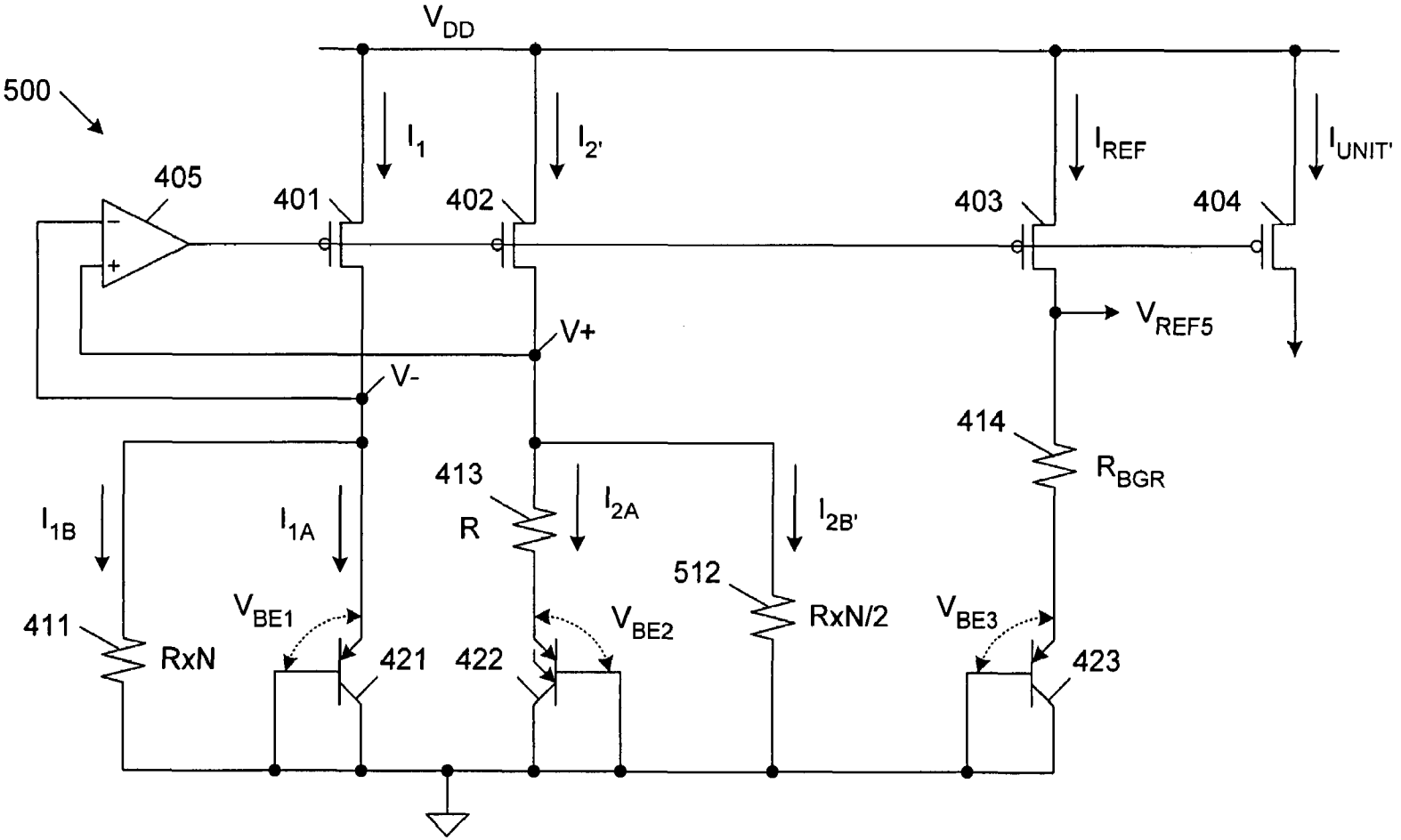
FIG. 5 is a circuit diagram of an on-chip bandgap voltage and current reference circuit in accordance with another embodiment of the present invention.

FIG. 5 is a circuit diagram of an on-chip bandgap voltage and current reference circuit 500 in accordance with another embodiment of the present invention. Voltage and current reference circuit 500 can be used, for example, in CMOS analog/mixed signal chips.

Because voltage and current reference circuit 500 (FIG. 5) is similar to voltage and current reference circuit 400 (FIG. 4), similar elements in FIGS. 4 and 5 are labeled with similar reference numbers. Thus, voltage and current reference circuit 500 includes PMOS transistors 401–404, operational amplifier 405, resistors 411 and 413–414 and PNP bipolar transistors 421–423, which have been described above in connection with FIG. 4. In addition, voltage-reference circuit 500 includes resistor 512, which replaces resistor 412 of voltage-current reference circuit 400. Resistor 512 has a resistance equal to (R×N/2). Thus, resistor 512 has a resistance equal to half of the resistance of resistor 412. As described in more detail below, this helps to ensure that reference circuit 500 only has one steady-state operating condition.

Reference circuit 500 operates in a manner similar to reference circuit 400, with the differences noted below. As described above, operational amplifier 405 forces the voltages V+ and V− to be the same (i.e., $V_{BE1}$). The current $I_{2B'}$ through resistor 512 can therefore be defined as follows.

$$I_{2B'}=2\times V_{BE1}/(R\times N) \quad (23)$$

The current $I_{2A}$ through resistor 413 can be defined as follows. (See, Equation (18) above)

$$I_{2A}=\Delta V_{BE}/R \quad (24)$$

From equations (23) and (24), the current $I_{2'}$ through PMOS transistor 402 can be defined as follows.

$$I_{2'}=\Delta V_{BE}/R+2\times V_{BE1}/(R\times N) \quad (25)$$

The current $I_{2'}$ is reflected to transistor 404 as the reference current $I_{UNIT'}$. The term $\Delta V_{BE}$ has a positive temperature coefficient, and the term $V_{BE1}$ has a negative temperature coefficient and the resistance R has a positive temperature coefficient. As a result, the temperature variation of current $I_{UNIT'}$ can be compensated by the resistor ratio N. Thus, current $I_{UNIT'}$ is insensitive to variations in temperature. Note that the resistor ratio N is selected to compensate the temperature variation of the current, not the voltage. As a result, the current reference $I_{UNIT'}$ can be generated directly.

Circuit 500 also enables a reference voltage $V_{REF5}$ to be generated. The reference voltage $V_{REF5}$ can be defined as follows.

$$V_{REF5}=V_{BE3}+I_{REF'}\times R_{BGR} \quad (26)$$

Because the current $I_{REF'}$ is equal to the current $I_{2'}$, equation (26) can be rewritten as follows.

$$V_{REF5}=V_{BE3}+[\Delta V_{BE}/R+2\times V_{BE1}/(R\times N)]\times R_{BGR} \quad (27)$$

$$V_{REF5}=V_{BE3}+R_{BGR}\times\Delta V_{BE}/R+2R_{BGR}\times V_{BE1}/(R\times N) \quad (28)$$

Because $\Delta V_{BE}$ has a negative temperature coefficient and $R_{BGR}$ has a positive temperature coefficient, the reference voltage $V_{REF5}$ can be independent of temperature when the resistor ratio N is properly selected. Moreover, the reference voltage $V_{REF5}$ is determined by the resistance ratio $R_{GBR}$/R, which is not significantly influenced by the absolute value of the resistances. In the foregoing manner, PNP bipolar transistor 423 and bandgap reference resistor 414 enable the generation of a voltage reference $V_{REF5}$ that is insensitive to temperature variation.

Figure 1:
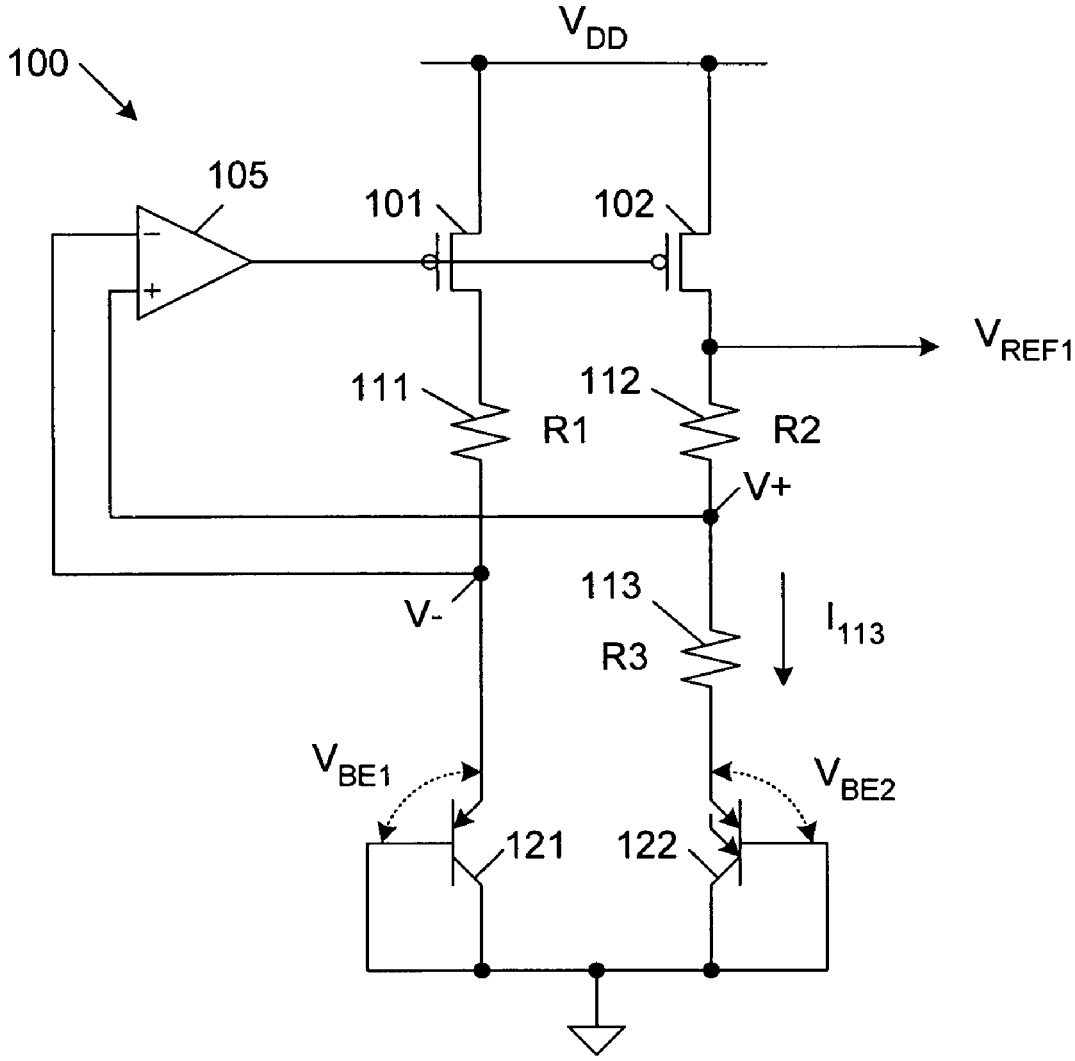
FIG. 1 (PRIOR ART)
FIG. 1 is a circuit diagram of a conventional on-chip bandgap voltage reference circuit used in CMOS analog/mixed signal chips.
Figure 2:
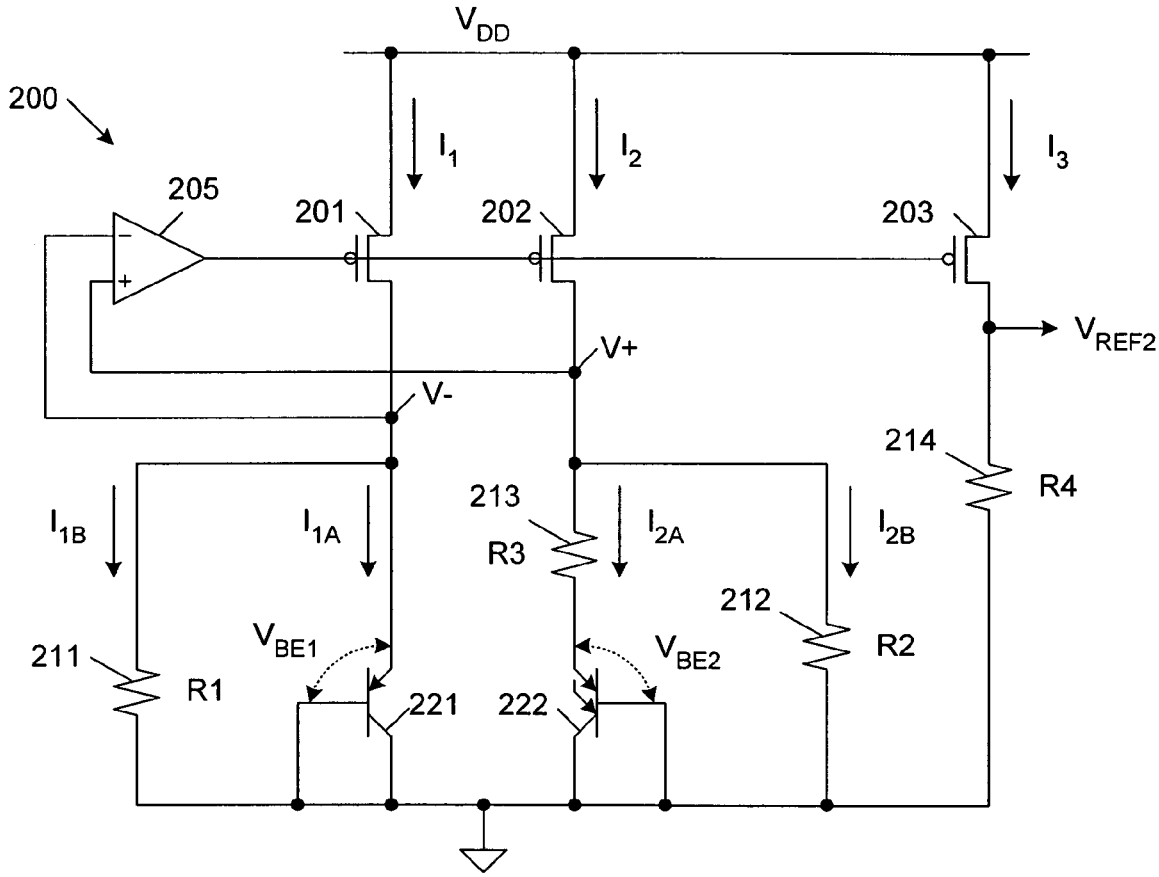
FIG. 2 (PRIOR ART)
FIG. 2 is a circuit diagram of another conventional bandgap voltage reference circuit.
Figure 3:
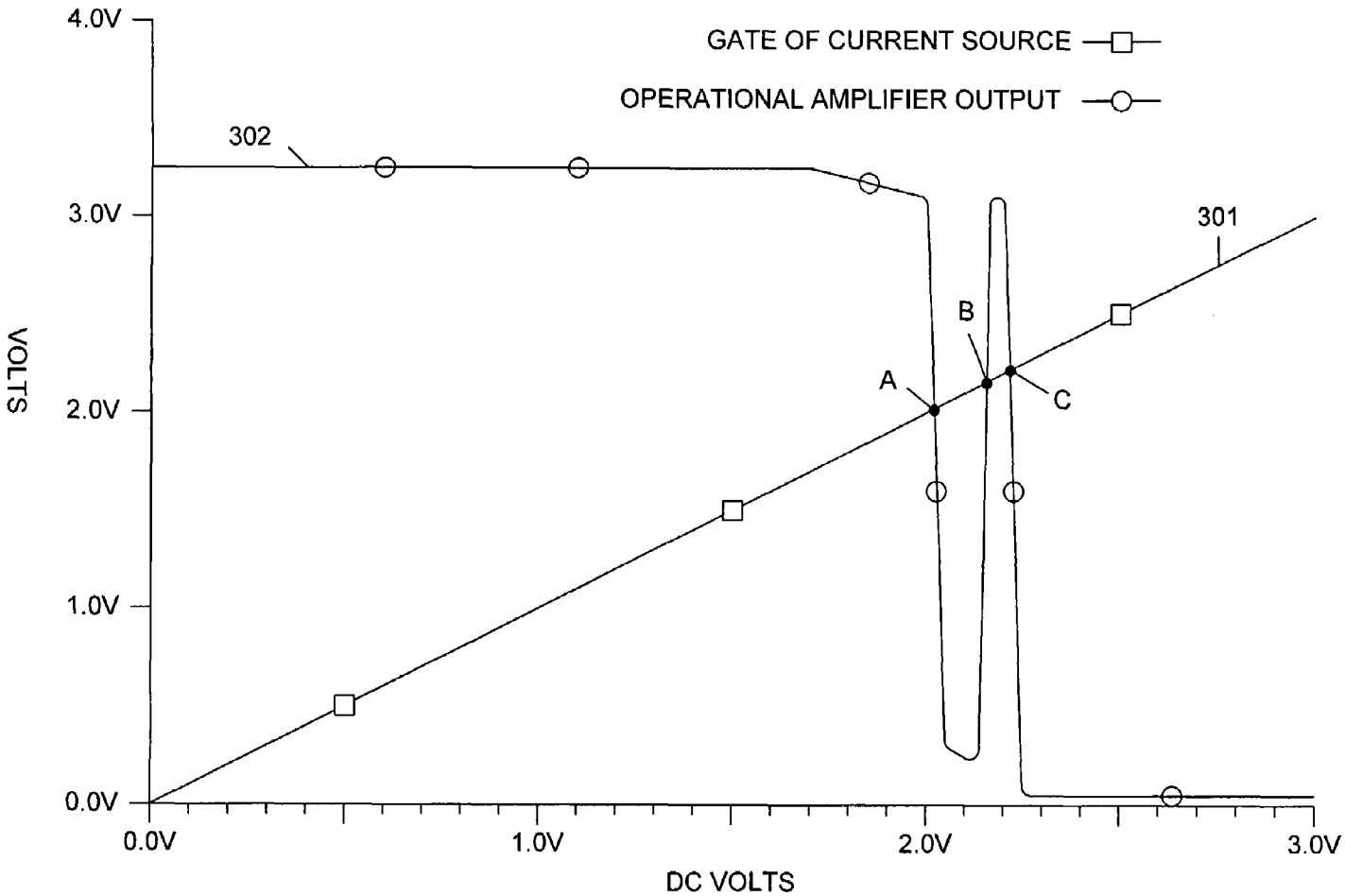
FIG. 3 (PRIOR ART)
FIG. 3 is a graph that illustrates a simulated DC voltage sweep on the gates of transistors of the voltage reference circuit of FIG. 2.
Figure 6:
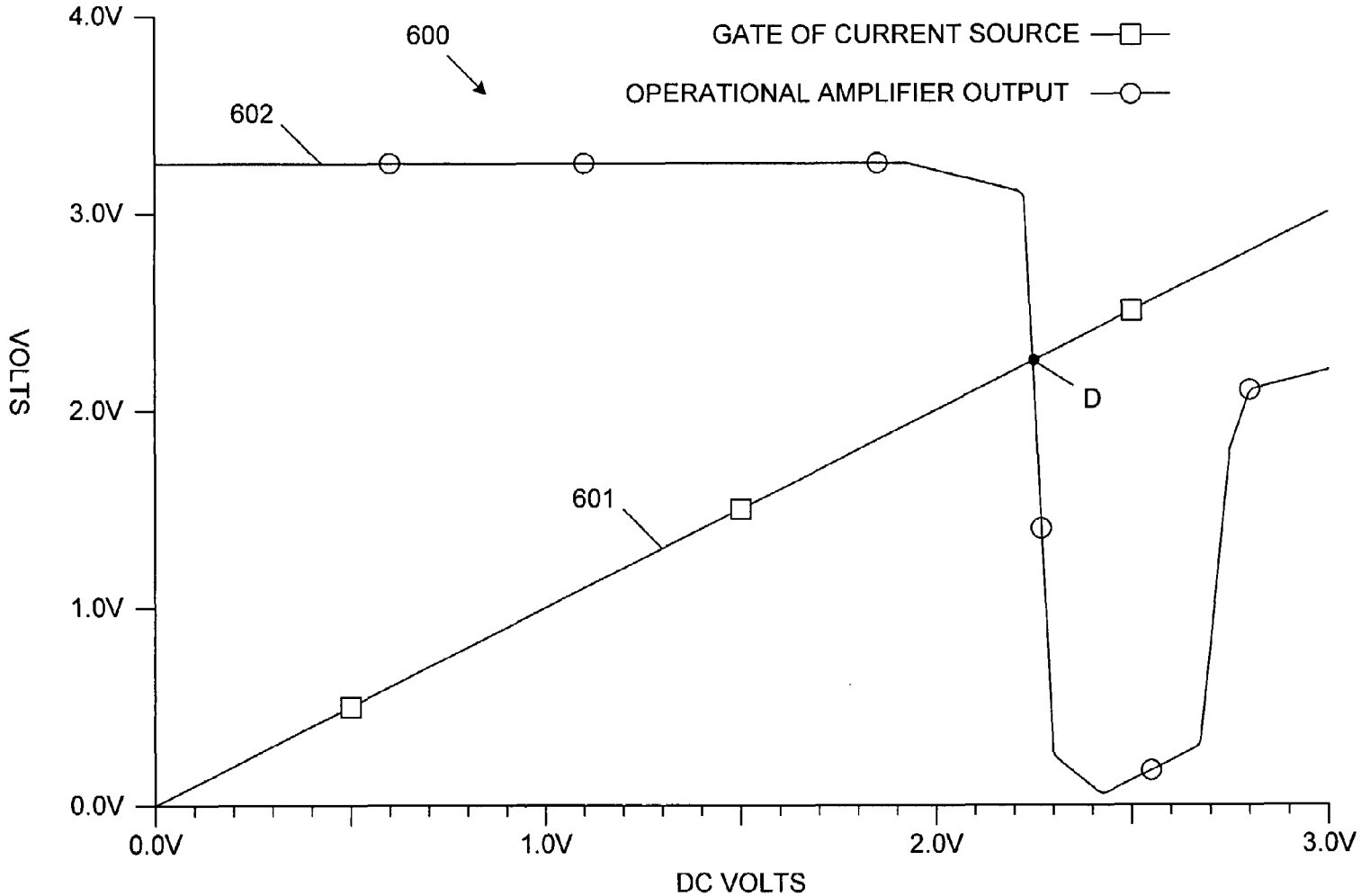
FIG. 6 is a graph that illustrates a simulated DC voltage sweep on the gates of transistors of the voltage and current reference circuit of FIG. 5.

FIG. 6 is a graph 600 that illustrates a simulated DC voltage sweep from 0 Volts to 3 Volts on the gates of transistors 401–404 (line 601), and the resultant output voltage of operational amplifier 405 (line 602). In this simulation, the output terminal of operational amplifier 405 is disconnected from the gates of PMOS transistors 401–404. Graph 600 illustrates that there is one cross-point, D, where the output of operational amplifier 405 is equal to the voltage applied to the gates of transistors 401–404. Thus, there is only one possible steady state operating condition for reference circuit 500, thereby ensuring that this circuit ends up in the desired operating state. In this manner, resistor 512 avoids the start-up problem illustrated in FIG. 3, such that the reference circuit 500 only has one steady state condition.

In the foregoing manner, the reference circuits 400 and 500 provide both current and voltage references. Both are insensitive to the variations of temperature and power supply. The typical variation of such a circuit is less than +/−10%, which is limited by the process variation. This is an improvement over the prior art reference circuits 100 and 200, which exhibit a +/−30% variation in associated reference currents.

Although the invention has been described in connection with several embodiments, it is understood that this invention is not limited to the embodiments disclosed, but is capable of various modifications, which would be apparent to a person skilled in the art. Thus, the invention is limited only by the following claims.

We claim:

1. A reference circuit comprising:

a first bipolar transistor that exhibits a first voltage drop $V_{BE1}$;

a second bipolar transistor that exhibits a second voltage drop $V_{BE2}$;

a first resistor having a resistance R1, the first resistor being configured to draw a first current proportional to $(V_{BE1}-V_{BE2})/R1$;

a second resistor having a resistance R2, the second resistor being configured to draw a second current proportional to $V_{BE1}/R2$;

a first transistor configured to supply the first and second currents; and a second transistor configured in a current mirror circuit with the first transistor, wherein the second transistor provides a reference current proportional to $(V_{BE1}-V_{BE2})/R1+V_{BE1}/R2$.

a third resistor having a resistance R3 and being coupled in parallel with the first bipolar transistor, the third resistor being configured to draw a third current proportional to $V_{BE1}/R3$, wherein the third resistance R3 is greater than the second resistance R2;

a third transistor configured to supply current to the third resistor and the first bipolar transistor; and an operational amplifier having input terminals coupled to drains of the first and third transistors, and an output terminal coupled to gates of the first, second and third transistors.

2. The reference circuit of claim 1, further comprising:

a fourth transistor configured in a current mirror configuration with the first transistor, wherein the fourth transistor provides a reference current proportional to $(V_{BE1}-V_{BE2})/R1+V_{BE1}/R2$;

a fourth resistor having a resistance R4; and a third bipolar transistor that exhibits a third voltage drop $V_{BE3}$, wherein the fourth resistor and the third bipolar transistor are connected in series with the fourth transistor, such that a voltage drop proportional to $V_{BE3}+R4[(V_{BE1}-V_{BE2})/R1+V_{BE1}/R3]$ exists across the fourth resistor and the third bipolar transistor.

3. The reference circuit of claim 1, wherein the resistance R1 is less than the resistance R2.

4. The reference circuit of claim 1, wherein the first voltage drop $V_{BE1}$ is greater than the second voltage drop $V_{BE2}$.

5. The reference circuit of claim 1, wherein the first bipolar transistor and the second bipolar transistor are PNP bipolar transistors.

6. The current reference circuit of claim 1, wherein the first, second and third transistors are p-channel MOS transistors.

7. The current reference circuit of claim 1, wherein the second resistance R2 is about half of the third resistance R3.

8. A reference circuit comprising:

a first circuit branch including a first bipolar transistor and a first resistor connected in parallel between a first control terminal and a first voltage supply terminal, wherein the first bipolar transistor exhibits a first voltage drop $V_{BE1}$, and the first resistor exhibits a first resistance R1;

a second circuit branch including a second resistor connected between a second control terminal and the first voltage supply terminal, and a second bipolar transistor and a third resistor connected in series between the second control terminal and the first voltage supply terminal, in parallel with the second resistor, wherein the second bipolar transistor exhibits a second voltage drop $V_{BE2}$, and the second resistor exhibits a second resistance R2, and the third resistor exhibits a third resistance R3, wherein R1>R2>R3; and a third circuit branch including a third bipolar transistor and a fourth resistor connected in series between a reference voltage output terminal and the first voltage supply terminal, wherein the first, second and third circuit branches are connected in a current mirror configuration, such that a reference voltage is provided on the reference output voltage terminal.

9. The reference circuit of claim 8, further comprising a differential amplifier having a first input terminal coupled to the first control terminal, a second input terminal coupled to the second control terminal, and an output terminal coupled to the first, second and third circuit branches.

10. The reference circuit of claim 8, further comprising a fourth circuit branch connected in a current mirror configuration with the first, second and third circuit branches, wherein the fourth circuit branch includes a transistor that directly provides a reference current representative of a current in the second circuit branch.

11. The reference circuit of claim 8, wherein the first voltage supply terminal is coupled to ground.

12. The reference circuit of claim 8, wherein the third resistor is configured to draw a current proportional to $(V_{BE1}-V_{BE2})/R3$.

13. The reference circuit of claim 8, wherein the first resistor is configured to draw a first current proportional to $V_{BE1}/R1$.

14. The reference circuit of claim 8, wherein the second circuit branch is configured to draw a current proportional to $(V_{BE1}-V_{BE2})/R3+V_{BE1}/R2$.

15. The reference circuit of claim 8, wherein the second resistance R2 is about half of the first resistance R1.

16. The reference circuit of claim 15, wherein the first resistance R1 equal to the third resistance R3 times an integer.

17. A method comprising:

creating a first current in a first circuit branch including a first bipolar transistor and a first resistor connected in parallel between a first control terminal and a first voltage supply terminal, wherein the first bipolar transistor exhibits a first voltage drop $V_{BE1}$, and the first resistor exhibits a first resistance R1;

creating a second current in a second circuit branch including a second resistor connected between a second control terminal and the first voltage supply terminal, and a second bipolar transistor and a third resistor connected in series between the second control terminal and the first voltage supply terminal, in parallel with the second resistor, wherein the second bipolar transistor exhibits a second voltage drop $V_{BE2}$, and the second resistor exhibits a second resistance R3, and the third resistor exhibits a third resistance R3, wherein R1>R2>R3; and creating a third current in a third circuit branch including a third bipolar transistor and a fourth resistor connected in series between a reference voltage output terminal and the first voltage supply terminal, wherein the first, second and third circuit branches are connected in a current mirror configuration, such that a reference voltage is provided on the reference output voltage terminal.

18. The method of claim 17, further comprising forcing the voltages on the first and second control terminals to be equal.

* * * * *